United States Patent [19]

Carey-Yard

[11] Patent Number: 4,850,752

[45] Date of Patent: Jul. 25, 1989

[54] TOOL FOR STONE-BLOWING

[75] Inventor: Andrew S. Carey-Yard, Weybridge, England

[73] Assignee: Kango Wolf Power Tools Limited, London, England

[21] Appl. No.: 151,503

[22] Filed: Feb. 2, 1988

[30] Foreign Application Priority Data

Feb. 3, 1987 [GB] United Kingdom ..... 8702354

[51] Int. Cl.[4] ..... B65G 53/14

[52] U.S. Cl. ..... 406/153; 104/2; 417/174; 406/38; 406/194; 406/144; 406/157

[58] Field of Search ..... 406/38, 108, 122, 151, 406/152, 153, 145, 139, 144, 93, 154, 157, 164, 167, 191, 194, 195, 198, 158, 121; 104/2, 7.3; 37/104, 142.5; 171/16; 417/151, 174

[56] References Cited

U.S. PATENT DOCUMENTS

| | | | |
|---|---|---|---|
| 187,536 | 2/1877 | Kimball | 406/157 |
| 2,447,216 | 8/1948 | Tidwell | 104/2 X |
| 2,955,880 | 10/1960 | Schlicksupp | 406/153 |
| 2,997,001 | 8/1961 | Scheuchzer | 104/2 |
| 4,370,819 | 2/1983 | Ingram | 37/104 |
| 4,477,210 | 10/1984 | Yare | 406/167 X |

FOREIGN PATENT DOCUMENTS

| | | | |
|---|---|---|---|
| 419531 | 11/1922 | Fed. Rep. of Germany | 406/144 |
| 1147553 | 4/1963 | Fed. Rep. of Germany | 406/195 |
| 209430 | 10/1985 | Japan | 406/153 |
| 38279 | 12/1955 | Poland | 104/2 |
| 689680 | 4/1953 | United Kingdom | 406/144 |
| 1380398 | 1/1975 | United Kingdom | 37/142.5 |
| 8603732 | 7/1986 | World Int. Prop. O. | 406/153 |

*Primary Examiner*—Sherman D. Basinger
*Assistant Examiner*—James M. Kannofsky
*Attorney, Agent, or Firm*—Wenderoth, Lind & Ponack

[57] ABSTRACT

There is provided a tool for stone-blowing comprising upper and lower mating parts (13, 14), the upper part being tubular and the lower part being mainly of channel section and having its lower end closed off by a transverse wall. The wall is shaped internally (19) to direct stones laterally and is shaped externally (22) to facilitate driving the tool into the ground adjacent a sleeper (33) so that the open front of the channel communicates with a void (34) beneath the sleeper. On the upper part is a hopper (11) for stones and below the hopper opening into the upper part is a compressed air inlet (26) and a port (24). In use, compressed air is directed at the rear wall and entrains air through the port (24) and the hopper (11) thereby propelling the stones down the tool and through the open front of the channel and into the void (34).

16 Claims, 2 Drawing Sheets

TOOL FOR STONE-BLOWING

Figure 1:
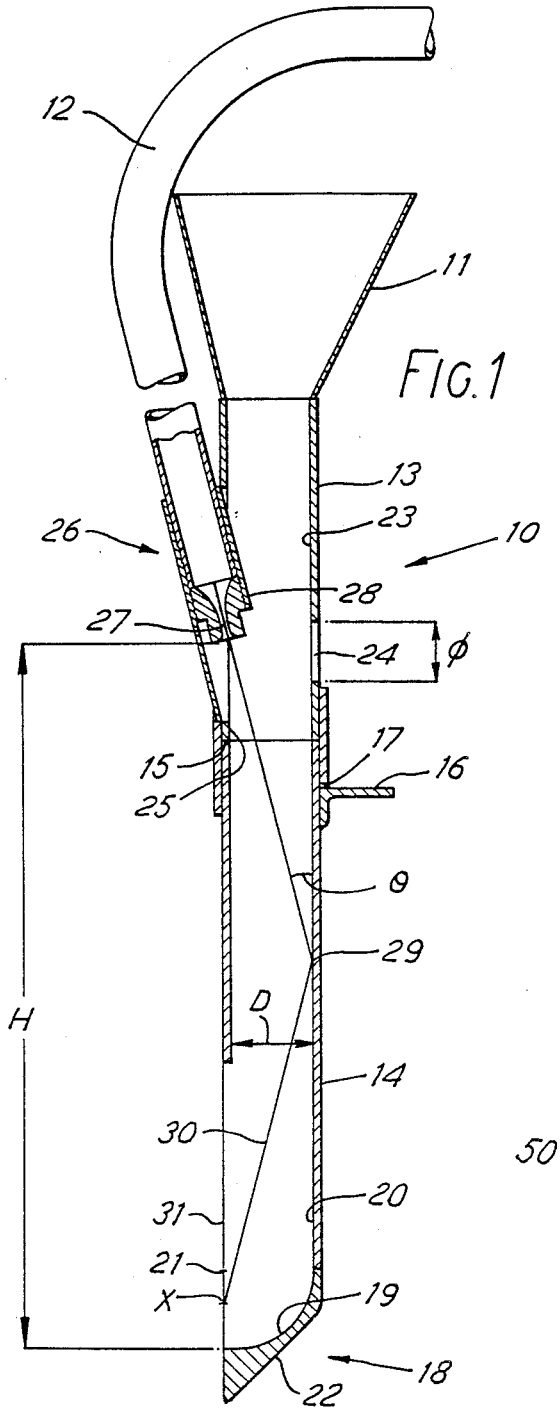

This invention relates to tools for stone-blowing and more particularly but not exclusively to tools used in the maintenance of railway track.

According to the present invention there is provided a tool for use in stone-blowing comprising a first portion of generally tubular section, a second portion of generally channel section in alignment with and forming a continuation of said first portion, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, a compressed air inlet opening into the first portion at a position below the stone inlet and directed away from the stone inlet, and a port located at a position below the stone inlet, the arrangement being such that, in use of the tool, the flow of compressed air entrains air through the stone inlet and through said port.

It will be appreciated that the tubular section described above may be of any cross-section and in one preferred embodiment is a hollow rectangular section.

Preferably the port is located on the opposite side of the tubular portion to said compressed air inlet.

Conveniently the compressed air inlet is located in the tubular portion above the open front of the channel portion and is directed towards the back face of the channel portion.

In a preferred embodiment the angle of entry of the compressed air through said air inlet is such that the air rebounds from the back face of the channel and intersects the general plane of the open front of the channel portion at a point near the transverse wall of the second portion and in another preferred embodiment the internal shaped surface of the transverse wall is quarter-circular for deflecting stones into the underground void, and said point is halfway between the centre defining the circular surface and said transverse wall.

In use of the tool the said point is preferably halfway between the underside of the sleeper and the transverse wall.

Conveniently the tool comprises upper and lower mating parts, in the upper of which is located the stone inlet. Preferably a restriction is provided in the upper mating part thereby to constitute a barrier to stones which are larger than a predetermined size, and in preferred arrangements the restriction is constituted by part of the compressed air inlet.

In another arrangement a hopper for stones is mounted on the stone inlet, the cross-sectional area of the hopper reducing in a direction towards the stone inlet.

In a further preferred embodiment a rigid air supply line is connected to the compressed air inlet, which supply line is arranged so as to constitute a carrying handle for the tool. Also said air inlet may incorporate a nozzle.

Figure 3:
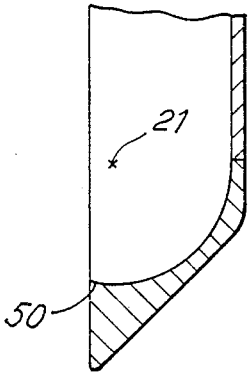
Figure 2:
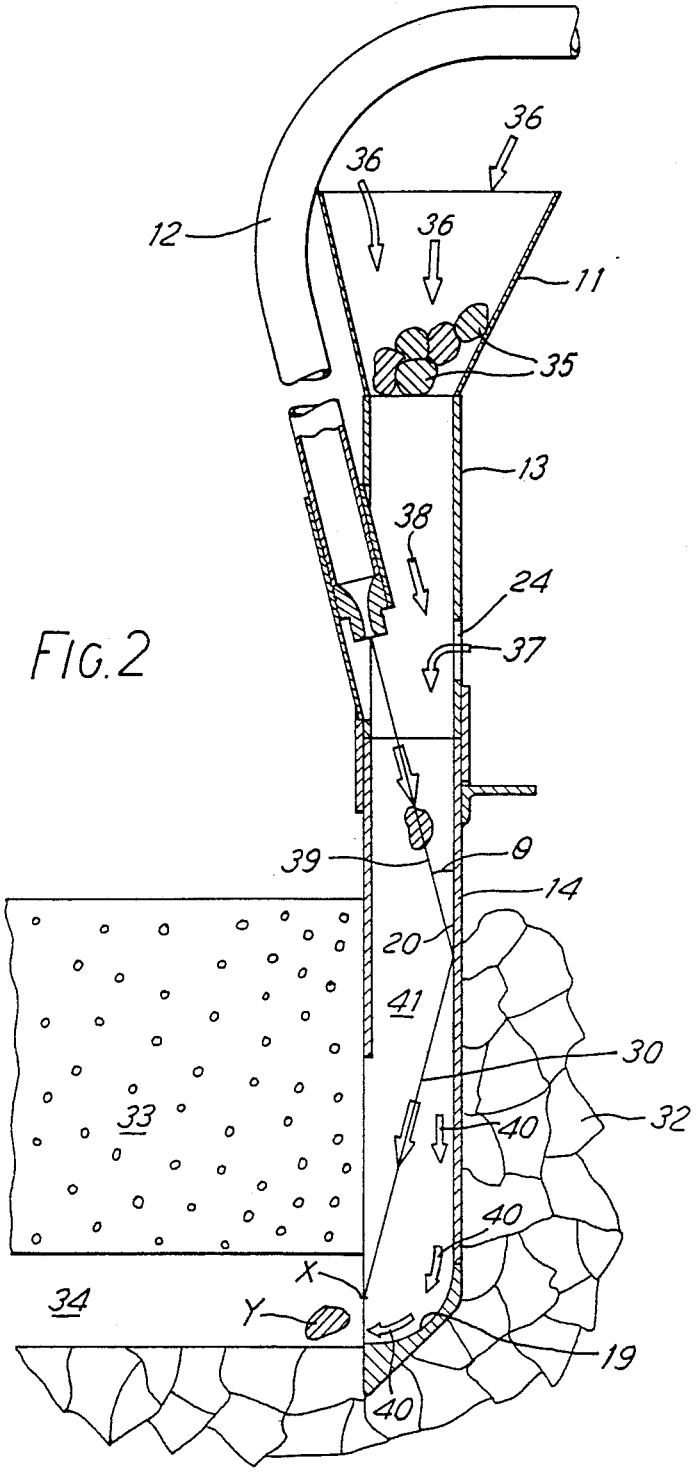

One embodiment of the invention will now be described in more detail with reference to the accompanying diagrammatic drawings in which:

FIG. 1 is a part-sectional side view of a tool according to the present invention, FIG. 2 is a part-sectional side view of a tool as shown in FIG. 1 in use, and FIG. 3 is a sectional side view on an enlarged scale of a modified lower end of tool.

FIG. 1 shows a tool 10 for stone blowing comprising a hopper 11 for stones, a compressed air supply line 12, an upper part 13 of generally tubular cross-section, in this case hollow rectangular section, and a lower part 14 which is generally channel shaped in cross-section. The upper end of the lower part 14 is tubular and is dimensioned for mating with the upper part 13 to produce a flush joint 15 inside the tool. A key 16 is provided on the lower part for engagement with a slot 17 in the upper part to ensure correct orientation of the two parts.

The free end 18 of the lower part 14 has an inside surface 19 which is formed as a smooth continuation of the back face 20 of the channel and which is curved through approximately 90°. In this particular example the surface 19 is quarter-circular in cross-section with a centre at point 21. The outside surface 22 of the free end 18 is tapered to facilitate the driving of the tool into the ground.

In the rear face 23 of the tubular part 13, in this example approximately halfway down, is located a port 24 which effects communication between the inside of the tool and the atmosphere. In the front face 25 of part 13, in this case directly opposite the port 24, is a compressed air inlet 26 which is connected to the supply line 12 and which incorporates a nozzle 27.

When compressed air is introduced into the tool through the nozzle 27, atmospheric air is entrained both through the hopper 11 and through the port 24. The inlet 26 projects into the tubular part 13 at 28 and constitutes a restriction which forms with the rear face 23 a barrier to prevent stones which are too large from being blown through the tool. The compressed air inlet is directed at a point 29 on the back face of the channel portion 14 so that the reflected path 30 of the air intercepts the general plane 31 of the open front face of the channel at a point X mid-way between the centre point 21 and the lowermost point of the inside surface 19. This point X is, in use of the present arrangement, ideally situated halfway between the underside of the sleeper and the transverse wall. The significance of this geometry will be explained later.

FIG. 2 shows the tool in use. Before attaining this configuration the lower part 14 is detached from the upper part 13 and is driven into a ballast bed 32 alongside a sleeper 33 which has been raised so as to expose a void 34 between the bed and the sleeper. The lower part 14 is orientated so that the open front face of the channel faces the sleeper and is driven deep enough so that the void 34 communicates with the channel portion.

The upper part 13 together with the hopper 11 is then engaged on the lower part. The compressed air supply is turned on and the desired quantity of stones are introduced to the hopper 11. The resulting effect is explained below.

The jet of compressed air through the nozzle causes air to be entrained through the hopper 11 as indicated by arrows 36. The entrained air 36 is supplemented by air entrained through the port 24 as indicated by arrow 37 to produce a combined flow of entrained air indicated by arrow 38. The velocity of air entrained through the hopper increases in the downward direction because the cross-sectional area of the hopper decreases. Furthermore the stones in the hopper restrict the flow of entrained air through the hopper and thus cause more air to be entrained through the port 24. This ensures that a large mass flow of entrained air is present in the tool 10.

The jet of air, shown as a chain-dotted line 39, causes the entrained air 38 to flow towards the back face 20 of the tool. Due to the low angle of incidence with the back face, the entrained air forms a thin high velocity stream 40 of air along the back face which stream spreads laterally towards and along the side faces 41 (only one shown) of the lower part 14 as the stream flows towards and around the radiussed inside surface 19 of the tool.

The jet 39 however is reflected along path 30 towards the open mouth of the channel at point X.

Gravity and the flow of entrained air 36 move the stones from the hopper into the path of the jet 39 of compressed air which deflects the stones to the sides and back faces of the tool, thereby allowing the jet 39 to continue to entrain air efficiently. Some of the falling stones are then impinged by the reflected jet and directed generally along path 30 towards the mouth of the channel at point X. The remainder of the stones are impinged by the high velocity stream 40 flowing along the faces of the tool. These two flows of stones combine to give the stones a good horizontal exit velocity which propels the stones into and along the void in a very efficient manner.

The possibility of obstructions occurring in this tool is very low because of the restriction provided at 28 in the upper part 13 of the tool which restriction prevents stones which are too large from reaching the jet of compressed air. It will be appreciated that it is far easier to remove the upper part of the tool to unblock an obstuction at 28 than it is to remove the lower part 14, unblock the obstruction and then drive the lower part back into the ballast bed 32.

However should a blockage occur in the exit area of the tube, say at point Y, then the high velocity stream 40 generally has a large enough mass flow to dislodge the obstructions.

A number of points should be made clear concerning the angle of the compressed air inlet and the reflected path 30. Clearly the position of point X which is determined by the angle of the inlet and the tube dimensions must be located so that in most, if not all, uses of the tool point X is in the exit path of the tool and is not lying against the side face of the sleeper. In the latter case the stones impinged by the reflected jet 30 would hit the sleeper and then drop to the bottom of the tool, i.e. all their kinetic energy in the direction of the void would be lost. Similarly, the point X should not be located on the curved end face 19 of the tool.

It is thought that the angle of the air inlet itself is also important. If the angle of incidence of the jet is too high then the entrained air is not likely to form the high velocity stream 40 along the faces of the tool. Conversely if it is too small then it is unlikely that the stones will be deflected and the entrainment of air will therefore be adversely affected as would, in turn, the high velocity stream 40. The importance of this stream in connection with unblocking the exit area of the tool has been discussed above.

The size of port 24 is such that full entrainment can be achieved through the port if the flow of air through the hopper is reduced to zero. The position of the port 24 is such that unless air entrainment through the hopper is reduced or stopped then very little air is entrained through port 24. Port 24 therefore acts as a form of 'top-up' facility to ensure that a large mass flow of air is achieved at all times.

It has been found that a tool having a square section tubular portion with a circular port 24 and having the following selected measurements is particularly advantageous although only an example.

Angle of incidence of air—$\theta = 14°$

Height from inlet to transverse wall—$H = 62.6$ cms

Depth from front face to back face—$D = 4.2$ cms

Diameter of port—$\phi = 3.2$ cms

The key 16 is also used to facilitate removal of the lower part 14 from the ballast bed. Furthermore the rigid air supply line 12 is also used as a carrying handle for the upper part of the tool or for the tool as a whole.

In the embodiment shown in FIG. 3, the centre 21 of the part-circular inside surface 19 of the tool is located inwardly of the plane of the open face of the channel and the front end portion 50 of the inside surface 19 is in the form of a lip which is a smooth continuation of said inside surface. This lip may be a continuation of the circular arc of the surface 19. The lip serves two main purposes, namely to provide a small ramp to aid the propulsion of the stones into the void and to improve the wear characteristics of the tool.

The tool herein disclosed uses a compressed air supply more efficiently than known tools. The present tool can be used continuously with a direct supply of air from a compressor and therefore renders the present system suitable for trackside transport by a small operating gang. Other known, less efficient arrangements however require such large quantities of compressed air that they cannot be used directly with a compressor alone, but must utilise a large receiver in conjunction with a compressor. Inevitably these known arrangements have to be stopped for considerable periods of time so that the receiver can be charged up by the compressor whereas the present system substantially increases workrate due to its continuous operation. With other known arrangements the equipment has to be mounted on a railway wagon and it is therefore necessary to have "possession"of the track i.e. the track is effectively closed to all trains. The wagon mounted systems also render it very difficult to conduct work on switches and crossings in a railway network.

According to another aspect the present invention provides a tool for use in stone-blowing comprising a first portion of generally tubular section, a second portion of generally channel section in alignment with and forming a continuation of said first portion, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, and a compressed air inlet opening into the first portion at a position below the stone inlet and directed away from the stone inlet so as, in use, to entrain air through the stone inlet, said air inlet incorporating a nozzle.

According to a further aspect the present invention provides a tool for use in stone-blowing comprising a first portion of generally tubular section, a second portion of generally channel section in alignment with and forming a continuation of said first portion, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, and a compressed air inlet opening into the first portion at a position below the stone inlet and directed towards the back face of the channel so that the angle of entry of the compressed air through said air inlet is such that this air rebounds from the back face of the channel and intersects the general plane of the open front of the channel at a point near the free end of the second portion.

According to a still further aspect the present invention provides a tool for use in stone-blowing comprising a first portion of generally tubular section, a second portion of generally channel section in alignment with and forming a continuation of said first portion, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, and a compressed air inlet opening into the first portion at a position below the stone inlet, said tool being constituted by upper and lower mating parts, in the upper of which is provided the stone inlet and a restriction to constitute a barrier for stopping stones which are larger than a predetermined size.

I claim:

1. A tool for use in stone-blowing comprising a first portion of generally tubular section, a second portion of generally channel section in alignment with and forming a continuation of said first portion and providing an open front, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, a compressed air inlet opening into the first portion at a position below the stone inlet and directed away from the stone inlet, and a port located at a position below the stone inlet, the arrangement being such that, in use of the tool, the flow of compressed air entrains air through the stone inlet and through said port.

2. A tool as claimed in claim 1 wherein the port is located on the opposite side of the tubular portion to said compressed air inlet.

3. A tool as claimed in claim 1 wherein the compresses air inlet is located in the tubular portion above the open front of the channel portion and is directed towards the face of the channel portion opposite said open front.

4. A tool as claimed in claim 1 wherein the angle of entry of the compressed air through said air inlet is such that the air rebounds from the face of the channel portion opposite said open front and intersects the general plane of the open front of the channel portion at a point near the transverse wall of the second portion.

5. A tool as claimed in claim 1 wherein the internal shaped surface of the transverse wall is quarter-circular in section for deflecting stones into the void.

6. A tool as claimed in claim 1 wherein said point of intersection is halfway between the center defining the quarter-circular surface and the transverse wall of the second portion.

7. A tool as claimed in claim 1 wherein the internal shaped surface is provided at its front end with an upturned lip for improving the lateral deflection of the stone, which lip is a smooth continuation of said internal shaped surface.

8. A tool as claimed in claim 1 wherein the tool comprises upper and lower mating parts, in the upper of which is located the stone inlet.

9. A tool as claimed in claim 8 wherein a restriction is provided in the upper mating part thereby to constitute a barrier to stones which are larger than a predetermined size.

10. A tool as claimed in claim 9 wherein said restriction is constituted by part of the compressed air inlet.

11. A tool as claimed in claim 1 wherein a hopper for stones is mounted on the stone inlet, the cross-sectional area of the hopper reducing in a direction towards the stone inlet.

12. A tool as claimed in claim 1 wherein a rigid air supply line is connected to said compressed air inlet, which supply line is arranged so as to constitute a carrying handle for the tool.

13. A tool as claimed in claim 1 wherein said compressed air inlet incorporates a nozzle.

14. A tool for use in stone-blowing comprising a first portion of generally tubular section, a second portion of generally channel section in alignment with and forming a continuation of said first portion and providing an open front, the end of said first portion remote from said second portion constituting an inlet for stones and the free end of said second portion being closed off by a transverse walls shaped externally to facilitate driving the tool into the ground in an upstanding attitude for aligning at least a section of the open front of the second portion with an underground void and shaped internally to deflect laterally through said open front stones moving along the second portion, and a compressed air inlet opening into the first portion at a position below the stone inlet and directed away from the stone inlet so as, in use, to entrain air through the stone inlet, said air inlet incorporating a nozzle.

15. A tool for use in stone-blowing comprising a first portion of generally tubular section, a second portion of generally channel section in alignment with and forming a continuation of said first portion and providing and open front, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, and a compressed air inlet opening into the first portion at a position below the stone inlet and directed towards the face of the channel portion opposite said open front so that the angle of entry of the compressed air through said air inlet is such that this air rebounds from said face of the channel and intersects the general plane of the open front of the channel at a point near the free end of the second portion.

16. A tool for use in stone-blowing comprising a first portion of generally tubular section, a second portion of generally channel section in alignment with and forming a continuation of said first portion and providing an open front, the end of said first portion remote from said second portion constituting an inlet for stones and the free end of said second portion being closed off by a transverse wall shaped externally to facilitate driving the tool into the ground in an upstanding attitude for aligning at least a section of the open front of the second portion with an underground void and shaped internally to deflect laterally through said open front stones moving along the second portion, and a compressed air inlet opening into the first portion at a position below the stone inlet, said tool being constituted by upper and lower mating parts, in the upper of which is provided the stone inlet and a restriction to constitute a barrier for stopping stone which are larger than a predetermined size.

* * * * *